US005268078A

United States Patent [19]

Koyama et al.

[11] Patent Number: 5,268,078

[45] Date of Patent: Dec. 7, 1993

[54] ALUMINUM PLATES FOR AUTOMOBILE BODY PANELS AND METHOD OF PRETREATMENT FOR PAINTING THEREOF

[75] Inventors: Takahiro Koyama, Nagoya; Yoshihumi Hasegawa; Tatsumi Takahashi, both of Nagoya, all of Japan

[73] Assignee: Sumitomo Light Metal Industries, Ltd., Tokyo, Japan

[21] Appl. No.: 957,355

[22] Filed: Oct. 6, 1992

Related U.S. Application Data

[62] Division of Ser. No. 837,286, Feb. 18, 1992, Pat. No. 5,176,963.

[30] Foreign Application Priority Data

| | | | |
|---|---|---|---|
| Feb. 19, 1991 | [JP] | Japan | 3-47807 |
| Feb. 19, 1991 | [JP] | Japan | 3-47808 |
| Feb. 19, 1991 | [JP] | Japan | 3-47809 |
| Feb. 19, 1991 | [JP] | Japan | 3-47810 |

[51] Int. Cl.[5] ..... C25D 13/20

[52] U.S. Cl. ..... 204/181.3; 205/85; 205/197; 148/256; 148/275

[58] Field of Search ..... 205/197, 85; 204/181.3; 148/256, 275

[56] References Cited

U.S. PATENT DOCUMENTS

| | | | |
|---|---|---|---|
| 3,982,055 | 9/1976 | Howard | 148/275 |
| 5,128,211 | 7/1992 | Tesdahl et al. | 148/256 |

FOREIGN PATENT DOCUMENTS

| | | | |
|---|---|---|---|
| 923579 | 4/1963 | United Kingdom | 205/85 |

*Primary Examiner*—Donald R. Valentine
*Assistant Examiner*—Kishor Mayekar
*Attorney, Agent, or Firm*—Flynn, Thiel, Boutell & Tanis

[57] ABSTRACT

This invention relates to Al plates suitable for automobile body panels and also relates to a method of pretreatment for painting. The features are: A Zn plating layer having 0.05~0.38 g/m$^2$ of coating weight is formed on the surface of an Al plate or Al alloy plate by a displacement plating process or electroplating process. The coated Al or Al alloy plate is subjected to chemical conversion treatment with zinc phosphate under conditions to completely dissolve the zinc plating layer. This invention prevents the occurrence of filiform rusting and blistering after painting.

4 Claims, 1 Drawing Sheet

ALUMINUM PLATES FOR AUTOMOBILE BODY PANELS AND METHOD OF PRETREATMENT FOR PAINTING THEREOF

This is a division of Ser. No. 07/837,286, filed Feb. 18, 1992 now U.S. Pat. No. 5,176,963.

FIELD OF THE INVENTION

This invention relates to aluminum plates (referred to simply as "Al plates" hereafter) for automobile body panels and relates to a method of pretreatment for painting thereof. In particular, it relates to Al plates coated with a zinc plating (referred to simply as "Zn plating" hereafter) layer as a pretreatment of painting of the Al plates for automobile body panels and relates to a method of pretreatment for painting using the Zn-plated Al plates.

BACKGROUND OF THE INVENTION

In recent years, studies on practical application of light weight Al group plates to external panels of automobile body as a substitute for the existing cold-drawn steel panels have been aggressively promoted to reduce the weight of automobile bodies.

Chemical conversion treatment with a phosphate is usually applied before painting to the cold-drawn steel plates, which are widely used for automobile bodies, to give corrosion resistance. Aluminum group plates also require similar pretreatment. Direct phosphate treatment on an Al group plate, however, results in significant degradation of treatment efficiency because of the inhibition effect of the dense oxide coating which is formed on the surface of the plate causing a degradation of the improvement effect against filiform rusting. Furthermore, since Al ions dissolve into the phosphate treatment solution to degrade the treatment efficiency, the smooth formation of overall phosphate coating is inhibited in the case of simultaneous treatment of steel plate parts with Al plates.

As countermeasures to such problems, Al group plates treated to form a metallic plating layer, such as Zn plating, thereon prior to the phosphate treatment have been proposed: JP-A-61-157693; JP-A-63-153262; JP-A-63-166964 (the term "JP-A-" refers "unexamined Japanese patent publication").

In the prior art, the main goals of forming a preliminary metallic layer, such as a Zn plating layer, on an Al group plate are to enable the simultaneous phosphate treatment of Al group plates, steel plates, and surface-treated steel plates, and to improve the chemical conversion treatment efficiency by preventing possible dissolution of Al ions and accumulation thereof.

An essential factor in the prior art is the presence of a metallic layer, such as a Zn plating layer, as an intermediate layer between an Al group plate and phosphate coating after the phosphate treatment. To realize such a sandwich configuration, a metallic layer, such as a Zn plating layer, must be formed to a thickness sufficient enough to prevent dissolution during the chemical conversion treatment. This thickness should correspond to a minimum of coverage 0.4 g/m$^2$.

In concrete terms, JP-A-61-157693 describes the use of an Al plate having a Zn plating layer of 1 g/m$^2$ or higher, JP-A-63-153262 specifies an Al plate with a Zn plating layer of 0.4 g/m$^2$ or higher formed thereon, and JP-A-63-166964 describes an Al plate plated with a coating weight of 0.4~5.0 g/m$^2$ of Zn.

According to studies performed by the inventors of this invention, however, the application of an Al group plate having a Zn coverage of 0.4 g/m$^2$ or higher to automobile body materials tends to result in a residual Zn layer on the Al plate after chemical conversion treatment. This residual Zn layer has been found to cause blistering during corrosion testing carried after painting.

SUMMARY OF THE INVENTION

This invention was derived by confirming the fact that, in the case of Al plates used as automobile body panels, the complete dissolution of the preliminarily formed Zn plating layer during the chemical conversion treatment is effective in improving corrosion resistance after painting. An object of this invention is to improve filiform rust resistance after painting and to provide Al plates for automobile body panels which do not generate blistering.

Another object of this invention is to provide Al plates having a Zn plating layer formed thereon as a pretreatment for painting of the Al plates for use as automobile body panels.

A further object of this invention is to provide a method of pretreatment for painting automobile body panels using the above described Al plates having the Zn plating layer thereon. The aforementioned objects of this invention are realized by forming a Zn plating layer at a coating weight ranging from 0.05 to 0.38 g-Zn/m$^2$ on a clean plate of Al or Al alloy. The above described objects of this invention are also realized by using a treatment method comprising the following steps: a first stage of cleaning a plate of Al or Al alloy and forming a Zn plating layer thereon; and a second stage carrying out a chemical conversion treatment with zinc phosphate under conditions promoting dissolution of the Zn plating layer formed in the first stage.

Aluminum plates, the base material of this invention, may be any kind of wrought products of Al or Al alloys, with no special limitations on materials or temper grade.

An example method of forming Zn plating layer on an Al group plate is to clean the surface of the Al group plate by, for example, dipping it into a dilute sulfuric acid bath, followed by coating with a thin layer of Zn or Zn alloy using a displacement plating process, electroplating process, or the like.

Especially, in case the structure of Zn layer piling up granular Zn particles as shown in FIG. 1 and FIG. 2 is formed, large surface area, accelerated Zn dissolution in the process of chemical conversion treatment with zinc phosphate, and increase of pH of the interface between Al surface and zinc phosphate layer can be obtained. Said conditions resulted in promoting the formation of zinc phosphate layer.

The displacement plating process consists of a cleaning stage wherein an Al group plate is dipped into, for example, a dilute sulfuric acid bath, and the Zn plating layer is formed by dipping the cleaned Al group plate into a Zn displacement plating bath or by spraying Zn displacement plating solution onto the cleaned Al plate. A preferable method for the displacement plating process is to use a plating bath having a composition of 10~300 g/l of sodium hydroxide and 5~50 g/l of zinc oxide at a temperature of 20° C. and to maintain a dipping time ranging from 2 to 60 sec. The displacement plating process is an extremely simple and economical way to perform Zn plating treatment and the displacement plating is a preferable method in order to make the structure of Zn layer piling up granular Zn particles.

The electroplating process consists of cleaning the surface of the Al plate by, for example, dipping it into a dilute sulfuric acid bath, and then forming a Zn or Zn alloy plating layer on the cleaned Al plate using an electroplating method. The preferable electroplating conditions for this invention are:

Zinc sulfate (hepta-hydrate): 300 g/l
Sodium sulfate: 50 g/l
pH: 1.6~1.8
Temperature: 50° C.
Current density: 5 A/dm$^2$
Duration of power application: 3~16 sec.

The electroplating process makes the control of aimed plating weight easy and enables fine adjustment of coating weight.

The displacement plating process and electroplating process can be used in parallel. In such a case, the surface of the Al group plate is cleaned by, for example, dipping into a dilute sulfuric acid bath, then the Zn plating layer is formed thereon using the Zn displacement plating process followed by the formation of a Zn or Zn alloy plating layer using the Zn electroplating process.

The Zn displacement plating process is carried out by dipping an Al group plate into a Zn displacement treatment bath. The preferred conditions (composition and temperature) relating to the objects of this invention are as follows:

Sodium hydroxide: 10~300 g/l
Zinc oxide: 5~50 g/l
Temperature: 20° C.

Since an excess thickness of plated layer formed by the Zn displacement plating process increases dispersion of aimed plating weight, the layer thickness is preferably set to a coating weight of 0.5 g/m$^2$ or lower.

The preferred conditions of the Zn electroplating process relating to the objects of this invention are as follows:

Zinc sulfate (hepta-hydrate): 300 g/l
Sodium sulfate: 50 g/l
pH: 1.6~1.8
Temperature: 50° C.
Current density: 5 A/dm$^2$
Duration of power application: 3~16 sec.

Parallel treatment with the displacement plating process and electroplating process enables the formation of an extremely thin Zn plating layer having strong adhesiveness while taking advantage of the convenience of the Zn displacement plating process without being affected by pretreatment, and allows the formation of a Zn electroplated layer with easy control of aimed plating weight on an extremely thin Zn plating layer. This treatment generates a Zn or Zn alloy plating layer having a smooth surface of uniform quality and an optimum coverage on the face of the Al group plate thereby improving the chemical conversion treatment efficiency and preventing the occurrence of filiform rusting.

The coating weight of Zn in the Zn plating layer formed during the first stage described above needs to be set at or lower than the etched quantity which will be dissolved out during the second stage, the zinc phosphate treatment stage. If the Zn coating weight exceeds the etched quantity, a portion of the Zn coating will remain after the zinc phosphate treatment, which will then cause blistering defects. Although the etched quantity of the Zn plating layer varies with the type of zinc phosphate treatment agent applied and the treatment condition, the upper limit of Zn coating weight is preferably set to 0.38 g/m$^2$ to assure the complete dissolution of Zn coating independent of the type of zinc phosphate treatment agent and the treatment condition. However, if a treatment agent and treatment condition having high activity are applied, the coating weight of Zn may be raised to 1.0 g/m$^2$.

If the coating weight of the Zn plating layer decreases to below 0.05 g/m$^2$, a uniform zinc phosphate coating cannot be formed during chemical conversion treatment, the second stage, and this tends to lead to filiform rusting.

Therefore, the coating weight of Zn in the Zn plating layer formed during the first stage is preferably set in a range of from 0.05 to 1.0 g/m$^2$, more preferably in a range of from 0.05 to 0.38 g/m$^2$.

As long as the coating weight of the Zn plating layer remains in a range of from 0.05 to 0.38 g/m$^2$, the Zn plating layer is dissolved and removed during the chemical conversion treatment with zinc phosphate under all conditions to form a normal coating of exclusively zinc phosphate on the surface of the Al group plate. In this case, corrosion resistance can be improved by making the surface scattering granular Zn particles and forming zinc phosphate layer on said surface. According to said coating structure, even if the zinc phosphate layer is broken, good corrosion resistance can be maintained by sacrificed anodic effect of Zn.

The second stage consists of a process to carry out chemical conversion treatment with zinc phosphate under conditions to dissolve the Zn plating layer which was formed during the first stage. Commercially available zinc phosphate treatment agents can be used in this stage. The activity of these agents and the treatment conditions must, however, be adjusted during chemical conversion treatment depending on the Zn coating weight of the Zn plating layer formed during the first stage.

The preferable coating weight of the zinc phosphate coating formed during the second stage is in a range of from 0.5 to 3 g/m$^2$.

During the first stage of this invention, the Zn plating layer is formed on a clean Al group plate to improve the efficiency of chemical conversion treatment and to prevent the occurrence of filiform rusting. During the second stage of this invention, chemical conversion treatment with zinc phosphate is applied to the Zn plating layer which was formed during the first stage. The chemical conversion treatment causes the Zn plating layer to dissolve into the treatment bath, thereby raising the pH value at the interface, which promotes the deposition of zinc phosphate. Fully exploiting the aforementioned dissolution mechanism of Zn, the once formed Zn plating layer is dissolved out leaving a coating layer of exclusively sole zinc phosphate, which does not induce blistering phenomena.

Through the treatment mechanisms of the first stage and the second stage, the occurrence of filiform rusting and blistering phenomena can be completely prevented, and the preliminary treatment for painting, effective as Al group plates for automobile body panels, is completed.

The Al group plates having a coating layer of exclusively zinc phosphate which was formed through the first stage and the second stage are transferred to a conventional automobile body painting process, where the external painting is performed.

DETAILED DESCRIPTION OF THE PREFERRED EMBODIMENT

Figure 1:
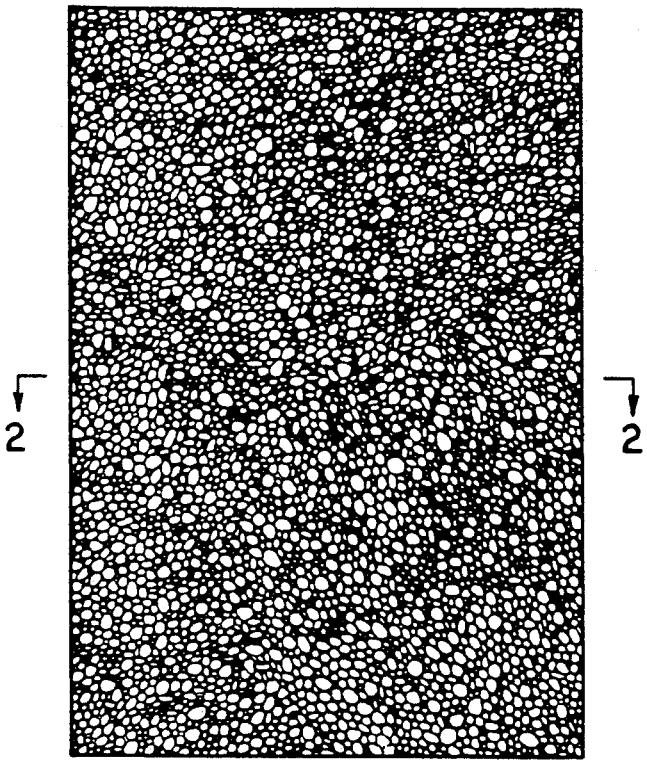
FIG. 1 shows the structure of Zn layer piling up granular Zn particles.
Figure 2:
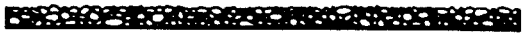
FIG. 2 is a sectional view taken along line 2—2 in FIG. 1.

The invention is described to a greater detail in the following referring to the examples and the comparative examples.

EXAMPLE 1

Samples (each having dimensions of 70 mm width, 150 mm length, and 1 mm thickness) of Al alloy plate containing 4.5% of Mg were subjected to surface cleaning treatment by dipping them into 2% dilute sulfuric acid solution at 70° C. for 1 min.

The cleaned samples were dipped into a plating bath having a composition of 120 g/l of sodium hydroxide and 20 g/l of zinc oxide at 20° C. for different periods, respectively to form a Zn plating layer having coating weights of 0.02, 0.07, 0.25, 0.38, and 0.40 g/m$^2$.

(A) An Al alloy sample having 0.02 g.m$^2$ of coating weight of Zn plating layer was degreased and surface treated by a conventional method followed by the dipping treatment with a commercial zinc phosphate treatment agent [Balbond L-3020, Nihon Parkarizing Co., Ltd.] under the treatment condition specified by the manufacturer to form a zinc phosphate coating. Examination of the coating layer formed by the chemical conversion treatment confirmed the non-uniform formation of an exclusively zinc phosphate coating layer with no trace of residual Zn plating layer.

Next, the surface of the sample coated with zinc phosphate was applied sequentially with cation electrodeposition coating, intermediate coating, and final coating to form a painted layer of 100 μm thickness. The obtained painted plate was subjected to filiform rusting test and blistering tests under the following conditions.

Filiform rusting test: A sample placed in a cross-cut was subjected to a salt water spraying for 24 hrs. The sample was then transferred to a thermostat (50° C., 80% RH) and left for 1,000 hrs. The generation of filiform rust was evaluated by measuring the total length of developed filiform rust.

Blistering test: A sample placed in a cross-cut was subjected to a degredation test for 60 cycles under the condition specified below to observe the state of blistering (number of blisters).

Period of salt water spray: 6 hrs.

Drying: 50° C., 8 hrs.

Constant temperature and humidity: 50° C., 80% RH, 10 hrs.

No blisters were found. Filiform rust of 2 mm in length was observed.

(B) An Al alloy sample having 0.07 g/m$^2$ of coating weight of Zn plating layer was subjected to zinc phosphate treatment under the same conditions as in the case of (A). Investigation of the coating layer revealed the formation of a uniform, exclusively zinc phosphate coating layer having 1.6 g/m$^2$ of coating weight with no residual Zn plating layer. The sample was then coated under the same conditions as in (A) and was tested for filiform rusting and blistering. No filiform rust nor blistering were observed.

(C) An Al alloy sample having 0.25 g/m$^2$ of coating weight of Zn plating layer was subjected to zinc phosphate treatment under the same conditions as in (A). Investigation of the coating layer revealed the formation of a uniform, exclusively zinc phosphate coating layer having 1.8 g/m$^2$ of coating weight on Al alloy surface scattering granular Zn particles. The sample was then coated under the same conditions as in (A) and was tested for filiform rusting and blistering. No filiform rust nor blistering were observed.

(D) An Al alloy sample having 0.38 g/m$^2$ of coating weight of Zn plating layer was subjected to zinc phosphate treatment under the same conditions as in (A). Investigation of the coating layer revealed the formation of a uniform, exclusively zinc phosphate coating layer having 2.0 g/m$^2$ of coating weight on Al alloy surface scattering granular Zn particles. The sample was then coated under the same conditions as in (A) and was tested for filiform rusting and blistering. No filiform rust nor blistering were observed.

(E) An Al alloy sample having 0.40 g/m$^2$ of coating weight of Zn plating layer was subjected to zinc phosphate treatment under the same conditions as in (A). Investigation of the coating layer revealed the presence of a double-layered structure configured with a zinc phosphate coating having 2.0 g/m$^2$ of coating weight over a residual layer of Zn plating. The sample was then coated under the same conditions as in (A) and was tested for filiform rusting and blistering. No filiform rusting occurred, but three blisters were found.

EXAMPLE 2

(1) The First Stage

Samples (each having dimensions of 70 mm width, 150 mm length, and 1 mm of thickness) of Al alloy plate containing 4.5% of Mg were subjected to surface cleaning treatment by dipping them into 2% sulfuric acid solution at 70° C. for 1 min.

The cleaned samples were dipped into a plating bath having a composition of 300 g/l of zinc phosphate {hepta-hydrate} and 50 g/l of sodium sulfate and having a pH value ranging from 1.6 to 1.8 at 50° C. to form an electroplating layer having a Zn coating weights of 0.3, 0.6, 1.5, and 15 g/m$^2$, respectively, under a current density of 5 A/dm$^2$ and a power application period ranging from 3 to 16 sec. A blank sample with no Zn coating was prepared as a reference.

(2) The Second Stage

Aluminum alloy samples coated with a Zn plating layer (prepared in the first stage) were degreased and surface treated by a conventional method followed by the dipping treatment with a commercial zinc phosphate treatment agent [Balbond L-3020, Nihon Parkarizing Co., Ltd.] under the treatment conditions specified by the manufacturer to form a zinc phosphate coating. For a sample having 0.6 g/m$^2$ of Zn coating weight, the period of dipping into the zinc phosphate agent was prolonged beyond the specified time to dissolve Zn completely.

(3) Evaluation After Painting

Cation electrodeposition coating, intermediate coating, and final coating were applied sequentially to the surface of samples coated with zinc phosphate to form a painted layer of 100 μm thickness.

The obtained painted plates were subjected to filiform rusting and blistering tests. The results are listed in Table 1 in relation to the Zn coating weight of the Zn electroplating layer formed during the first stage, the Zn residual state, and the condition of the zinc phosphate coating surface (unaided visual observation and SEM observation) formed during the second stage. The procedures of the filiform rusting and blistering tests are described below.

Filiform rusting test: A sample placed in a cross-cut was subjected to salt water spray for 24 hrs. The sample was then transferred to a thermostat (50° C., 80% RH) and left for 1,000 hrs. The generation of filiform rust was evaluated by measuring the total length of developed filiform rust.

Blistering test: A sample placed in a cross-cut was subjected to a degradation test for 60 cycles under the conditions specified below to observe the state of blistering (number of blisters).

Period of salt water spray: 6 hrs.

Drying: 50° C., 8 hrs.

Constant temperature and humidity: 50° C., 80% RH, 10 hrs.

TABLE 1

| Sample No. 15 | Coating weight of Zn (g/m2) | Residual quantity of Zn | Condition of zinc phosphate coating surface | Filiform rust (mm) | Blistering (quantity) |
|---|---|---|---|---|---|
| 1 | 0.3 | Non | Good (uniform) | 0 | 0 |
| 2 | 0.6 | Non | Good (uniform) | 0 | 0 |
| 3 | 1.5 | Remained | Good (uniform) | 0 | 5 |
| 4 | 15.0 | Remained | Good (uniform) | 0 | 6 |
| 5 | 0 | Non | Non-uniform | 4 | 0 |

In samples 1 and 2 listed in Table 1, the exclusively zinc phosphate coating surface formed in the second stage by dissolving the Zn plating layer formed during the first stage gave extremely uniform texture and displayed no defects such as filiform rust or blistering after painting. In contrast, in samples 3 and 4, which had residual quantities of the Zn plating layer after the second stage, generated blisters. In the comparative Example 3, which did not form a Zn plating layer, the zinc phosphate coating developed a non-uniform texture and generated filiform rust.

EXAMPLE 3

(1) The First Stage

Samples (each having dimensions of 70 mm width, 150 mm length, and 1 mm thickness) of Al alloy plate containing 4.5% of Mg were subjected to surface cleaning treatment by dipping them into 2% sulfuric acid solution at 70° C. for 1 min.

The cleaned samples were dipped into a plating bath having a composition of 240 g/l of sodium hydroxide and 40 g/l of zinc oxide at 20° C. to form a coating having 0.2, 0.5, and 1.2 g/m$^2$ of coating weight, respectively, by varying the dipping time with the zinc displacement plating process. A blank sample with no Zn coating was prepared as a reference.

(2) The Second Stage

Aluminum alloy samples coated with a Zn plating layer (prepared in the first stage) were degreased and surface treated by a conventional method followed by dipping treatment with a commercial zinc phosphate treatment agent [Balbond L-3020, Nihon Parkarizing Co., Ltd.] under the treatment conditions specified by the manufacturer to form a zinc phosphate coating. For a sample having 0.5 g/m$^2$ of Zn coating weight, the period of dipping into the zinc phosphate agent was prolonged beyond the specified time to dissolve Zn completely.

(3) Evaluation After the Painting

Cation electrodeposition coating, intermediate coating, and final coating were applied sequentially to the surface of samples coated with zinc phosphate to form a painted layer of 100 μm thickness.

The obtained painted plates were subjected to filiform rusting and blistering tests as performed in Example 2. The results are listed in Table 2 in relation to the Zn coating weight of the Zn electroplating layer formed during the first stage, the Zn residual state, and the condition of the zinc phosphate coating surface (unaided visual observation and SEM observation) formed during the second stage.

TABLE 2

| Sample No. | Coating weight of Zn (g/m2) | Residual quantity of Zn | Condition of zinc phosphate coating surface | Filiform rust (mm) | Blistering (quantity) |
|---|---|---|---|---|---|
| 1 | 0 | Non | Non-uniform | 4 | 0 |
| 2 | 0.2 | Non | Good (uniform) | 0 | 0 |
| 3 | 0.5 | Non | Good (uniform) | 0 | 0 |
| 4 | 1.2 | Remained | Good (uniform) | 0 | 5 |

As shown in Table 2, the exclusively zinc phosphate coating surface formed in the second stage by dissolving the Zn plating layer formed in the first stage gave extremely uniform texture and displayed no defects such as filiform rust or blistering after painting. In contrast, in sample 1, which did not form a Zn plating layer, the zinc phosphate coating developed a non-uniform texture and generated filiform rust. In sample 4, which had residual Zn plating layer, blistering was observed.

EXAMPLE 4

(1) The First Stage

Samples (each having dimensions of 70 mm width, 150 mm length, and 1 mm thickness) of Al alloy plate containing 4.5% of Mg were subjected to surface cleaning treatment by dipping them into 2% sulfuric acid solution at 70° C. for 1 min.

The cleaned samples were dipped into a plating bath having a composition of 200 g/l of sodium hydroxide and 30 g/l of zinc oxide at 20° C. for 3 sec. to form a Zn plating layer having 0.1 g/m$^2$ of coating weight by the Zn displacement plating process. These samples were then dipped into a plating bath having a composition of 300 g/l of zinc sulfate {hepta-hydrate} and 50 g/l of sodium hydroxide and having a pH value ranging from 1.6 to 1.8 at 50° C. to form an electroplating layer having a Zn coating weight of 0.3, 0.6, 1.6, and 15.1 g/m$^2$, respectively, under a current density of 5 A/dm$^2$ and a power application period ranging from 5 to 16 sec. A blank sample with no Zn coating layer was prepared as a reference.

(2) The Second Stage

Aluminum alloy samples coated with a Zn plating layer (prepared in the first stage) were degreased and surface treated by a conventional method followed by dipping treatment with a commerical zinc phosphate treatment agent [Balbond L-3020, Nihon Parkarizing Co., Ltd.] under the treatment conditions specified by the manufacturer to form a zinc phosphate coating. For a sample having 0.6 g/m$^2$ of Zn coating weight, the period of dipping into the zinc phosphate agent was prolonged beyond the specified time to dissolve Zn completely.

(3) Evaluation After the Painting

Cation electrodeposition coating, intermediate coating, and final coating were applied sequentially to surface of samples coated with zinc phosphate to form a painted layer of 100 μm thickness.

The obtained painted plates were subjected to filiform rusting and blistering tests performed as in Example 2. The results are listed in Table 3 in relation to the Zn coating weight of the Zn electroplating layer formed during the first stage, the Zn residual state, and the condition of the zinc phosphate coating surface (unaided visual observation and SEM observation) formed during the second stage.

TABLE 3

| Sample No. | Coating weight of Zn (g/m2) | Residual quantity of Zn | Condition of zinc phosphate coating surface | Filiform rust (mm) | Blistering (quantity) |
|---|---|---|---|---|---|
| 1 | 0.3 | Non | Good (uniform) | 0 | 0 |
| 2 | 0.6 | Non | Good (uniform) | 0 | 0 |
| 3 | 1.6 | Remained | Good (uniform) | 0 | 6 |
| 4 | 15.1 | Remained | Good (uniform) | 0 | 8 |
| 5 | 0 | Non | Non-uniform | 4 | 0 |

In the samples 1 and 2 listed in Table 3 the exclusively zinc phosphate coating surface formed in the second stage by dissolving the Zn plating layer formed during the first stage gave an extremely uniform texture and displayed no defects such as filiform rust or blistering after painting. In contrast, in samples 3 and 4, which had residual quantities of Zn plating layer after the second stage, generated blisters. In sample 5, which did not form a Zn plating layer, the zinc phosphate coating developed a non-uniform texture and generated filiform rust.

As described above, this invention provides Zn-plated Al group plates for automobile body panels. These plates simultaneously prevent the generation of filiform rusting and blistering after external painting owing to the complete dissolution of the Zn plating layer during the chemical conversion treatment, a succeeding process, resulting in an exclusively zinc phosphate coating. Thus, the Al plates provided by this invention are considered very useful as Al materials for automobile body external panels.

We claim:

1. A method of pretreatment for painting aluminum plates for automobile body panels, comprising the steps of: forming a zinc plating layer on said aluminum plates made of aluminum or aluminum alloy, and conducting chemical conversion treatment with zinc phosphate so that said zinc plating layer is completely dissolved and is completely removed from said plates.

2. The method of pretreatment for painting aluminum plates for automobile body panels as claimed in claim 1, wherein said zinc coating weight of said zinc plating layer is in a range of from 0.05 to 1.0 g/m$^2$.

3. The method of pretreatment for painting aluminum plates for automobile body panels as claimed in claim 1, wherein said zinc plating layer is formed by a zinc displacement plating process.

4. A method of pretreatment for painting aluminum plates for automobile body panels, comprising the steps of forming a zinc plating layer on said aluminum plates made of aluminum or aluminum alloy, and conducting chemical conversion treatment with zinc phosphate under conditions to dissolve completely said zinc plating layer, wherein said zinc coating weight of said zinc plating layer is in a range of from 0.05 to 0.38 g/m$^2$.

* * * * *